US006325670B2

(12) United States Patent
Murayama

(10) Patent No.: US 6,325,670 B2
(45) Date of Patent: Dec. 4, 2001

(54) WATERPROOF CONNECTOR

(75) Inventor: Toshisada Murayama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/805,947

(22) Filed: Mar. 15, 2001

(30) Foreign Application Priority Data

Mar. 16, 2000 (JP) ..... 12-074473

(51) Int. Cl.[7] ..... H01R 13/40
(52) U.S. Cl. ..... 439/587; 439/936; 439/274
(58) Field of Search ..... 439/587, 274, 439/275, 279, 936, 589

(56) References Cited

U.S. PATENT DOCUMENTS 5,934,922 * 8/1999 Chiotis ..... 439/587
6,120,324 * 9/2000 Murayama et al. ..... 439/587
6,132,230 * 10/2000 Shinozaki et al. ..... 439/281
6,171,145 * 1/2001 Murayama ..... 439/587

FOREIGN PATENT DOCUMENTS 8-250200 9/1996 (JP) .
2763300 3/1998 (JP) .

* cited by examiner

*Primary Examiner*—Tho D. Ta
(74) *Attorney, Agent, or Firm*—Sughrue, Mion, Zinn, Macpeak & Seas, PLLC

(57) ABSTRACT

A housing is provided with an abutment face formed inside thereof so as to define an insertion opening, to which a electric wire terminal is inserted, and a chamber for accommodating the inserted terminal. The terminal penetrates a gel member before being inserted to the chamber. A holder is provided with an insertion passage through which the terminal passes before penetrating the gel member. The holder is engaged with the housing while being movable between a provisional engagement position and a plenary engagement position. The gel member is compressed against the abutment face of the housing when the holder is placed in the plenary engagement position. The gel member is held by the holder without compressing against the abutment face, when the holder is placed in the provisional engagement position.

5 Claims, 10 Drawing Sheets

WATERPROOF CONNECTOR

BACKGROUND OF THE INVENTION

The present invention relates to a waterproof connector wherein a waterproofing gel through which a terminal passes is provided inside a connector housing, and relates in particular to a waterproof connector wherein a preferable sealing portion is formed when a gel is penetrated and the generation of gel chips is prevented.

Conventionally, grease is employed in certain cases to seal connector housings and electric wires led therefrom. However, high temperatures adversely affect and reduce the viscosity of grease, and when this occurs, the grease will leak from a sealed portion, thereby such a seal unstable. In addition to grease, an epoxy resin adhesive may be used for this type of sealing structure. But in this case, although a reliable sealing structure can be provided, after the adhesive has hardened, the insertion or re-insertion of a electric wire is impossible.

To resolve this problem, a waterproof connector is disclosed, in, for example, in Japanese Patent No. 2763300. As is shown in FIG. 12, a frame-shaped stopper 5 is projected inward along the inner periphery of an opening 3 at one end of a quadrilateral rear holder 1, in which openings are formed in parallel opposing ends. A plate-shaped base 7, in which a grid-shaped pattern of multiple terminal through holes 9 is formed, is inserted into the rear holder 1 and is positioned so that it contacts the stopper 5, which retains the base 7 and prevents it from slipping out through the opening 3.

Subsequently, a mat-shaped sealing member (gel) 13 is inserted through another opening 11 into the rear holder 1 wherein the base 7 is retained. As is shown in FIG. 13, the outer peripheral faces of the gel 13 closely contact the inner faces of the rear holder 1, and its forward surface is held against the rear of the base 7 by a protrusion 15. Then, as is shown in FIG. 14, the rear portion of a housing 17 is fitted into the rear holder 1 through the opening 11. As is shown in FIG. 15, for the insertion of terminals, openings 19, which communicate with terminal chambers, are formed in the rear portion of the housing 17. These openings 19, each of which is arranged opposite a corresponding terminal through hole 9 in the base 7, are separated from the terminal through holes 9 by the intervening gel 13.

To employ the thus assembled waterproof connector, terminals 23, connected to electric wires 21, are inserted into the terminal through holes 9 in the exposed face of the base 7 in the rear holder 1. As the terminals 23 are inserted, they break the surface of and pass through the gel 13 into the openings 19 and enter the terminal chambers in the housing 17, wherein they are retained. During this process, as the electric wires 21 pass through the gel 13, some of the gel 13, which adheres closely to the outer circumferences of the electric wires 21, is carried into the housing 17 and seals the gaps between the electric wires 21 and the housing 17.

Use of this waterproof connector forestalls the possibility that grease will leak out at high temperatures, which can occur if grease is used, and ensures that terminals can be removed and re-inserted, which is impossible when an epoxy adhesive is employed.

However, when the related waterproof connector is used, and the rear holder is fitted over the rear portion of the housing, the gel is sandwiched between the rear holder and the housing, and compressed. As a result, resistance to the passage of the terminals is increased, and since then the electric wires may be bent or the terminals may not be able to break through and penetrate the gel, deterioration of the operational efficiency of the terminal attachment occurs. Further, when there is excessive resistance to the passage of the terminals, the terminals may rub against and displace gel, and incomplete-sealing may occur at the areas penetrated by the terminals.

In addition, since the gel closely contacts all the surface around the circumferences of the terminal insertion openings, when, as is shown in FIG. 15, a terminal 23 is pressed against the gel 13 until it breaks the surface and passes through it, part of the gel 13, on the through hole exit side, that closely contacts the inner wall 25 can not recover and is extended and carried into the opening 19 with the terminal 23. This extended portion 13*a* is cut off, and forms chips 13*b*, as is shown in FIG. 16, and the chips 13 are carried into a terminal chamber 27 with the terminal 23. In this state, when this connector is coupled with another connector, the chips 13*b* may work in between the contact points of the terminals, and cause a conductive failure.

SUMMARY OF THE INVENTION

To resolve this problem, it is one objective of the present invention to provide a superior waterproof connector that can provide increased terminal insertion efficiency and improved sealing capability when terminals pass through a gel, and that can prevent any deterioration in conduction reliability resulting from gel chips that are transported into terminals.

In order to achieve the above object, according to the invention, there is provided a waterproof connector, comprising:

- a housing, provided with an abutment face formed inside thereof so as to define an insertion opening to which a electric wire terminal is inserted, and a chamber for accommodating the inserted terminal;
- a gel member, through which the terminal penetrates before being inserted to the chamber;
- a holder, provided with an insertion passage through which the terminal passes before penetrating the gel member, the holder engaged with the housing while being movable between a provisional engagement position and a plenary engagement position,
- wherein the gel member is compressed against the abutment face of the housing when the holder is placed in the plenary engagement position; and
- wherein the gel member is held by the holder without compressing against the abutment face, when the holder is placed in the provisional engagement position.

In this configuration, since the holder is located at a provisional engagement position, the terminal can penetrate the gel member before pressure is applied thereto, so that resistance to the passage of the terminals is reduced.

Preferably, the holder includes an engagement member for holding the gel member while preventing the gel member from moving toward the penetrating direction of the terminal.

In this configuration, since the overall distortion of the gel member is prevented, a local shearing force is efficiently acted on the gel member. Therefore, when the terminal penetrates through the gel member, the gel member is protected from being pulled and extended more than is necessary, and from experiencing extreme deformation and thinning. Thus, at those locations through which the terminal penetrates, a superior sealing effect is obtained.

Preferably, projections are formed in the housing so as to surround the insertion opening, while defining a space for which, a part of the compressed gel member runs off.

In this configuration, when a terminal is inserted into the connector housing, it first abuts against the gel member, and then, as the insertion process is continued, it breaks through and penetrates the gel member. At this time, as the terminal urges the gel member forward, part of the gel member escapes through the runoff space, thereby preventing the occurrence of the phenomenon wherein an extended portion of the compressed gel member can not escape and is carried into the chamber. Furthermore, when two connectors are coupled, gel chips do not enter the electrical contact portions, and all conductive failures due to gel chips can be prevented.

Preferably, a guide projection is formed in the housing so as to surround the insertion opening. The guide projection is inserted into the insertion passage of the holder, for guiding the insertion of the terminal, when the holder is placed in the provisional engagement position.

In this configuration, when the terminal, while passing through the gel member, reach the guide projection, which define a terminal guide gap that communicate with the insertion passage, they are accurately aligned with the insertion passage and guided to the chambers of the housing. Therefore, the terminals neither contact the inner walls of the housing, nor are they inserted into an irregular chamber.

DETAILED DESCRIPTION OF THE PREFERRED EMBODIMENTS

A waterproof connector according to the preferred embodiments will now be described in detail while referring to the accompanying drawings.

Figure 1:
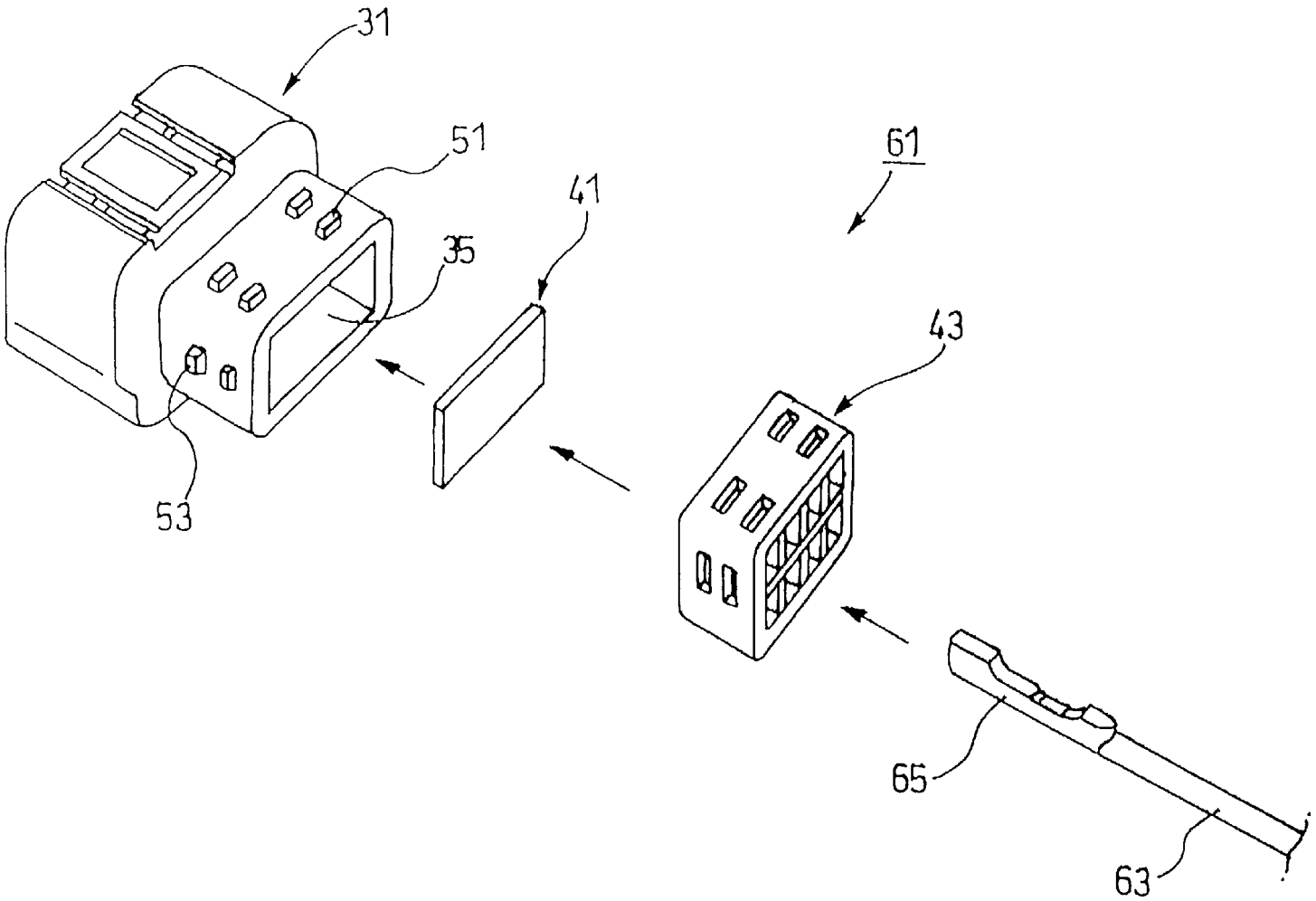
FIG. 1 is an exploded perspective view showing a waterproof connector according to a first embodiment of the invention.
Figure 2:
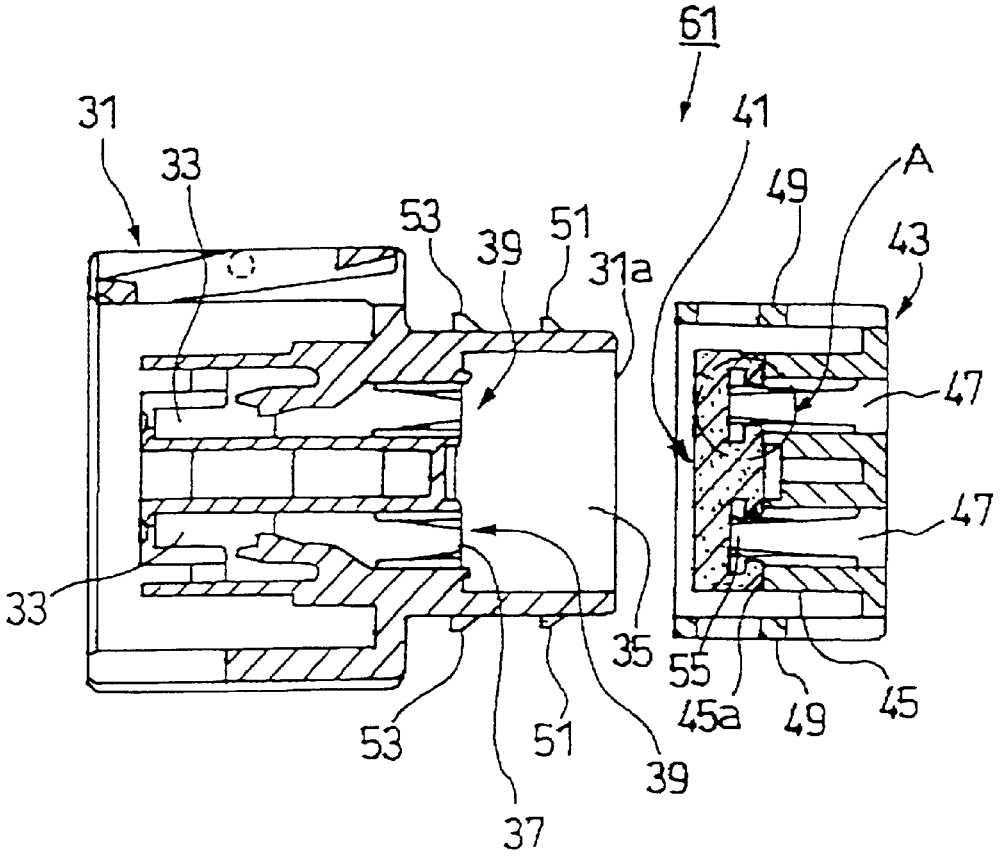
FIG. 2 is an exploded cross-sectional view showing the state wherein a rear holder of FIG. 1 integrally holds a gel.
Figure 3:
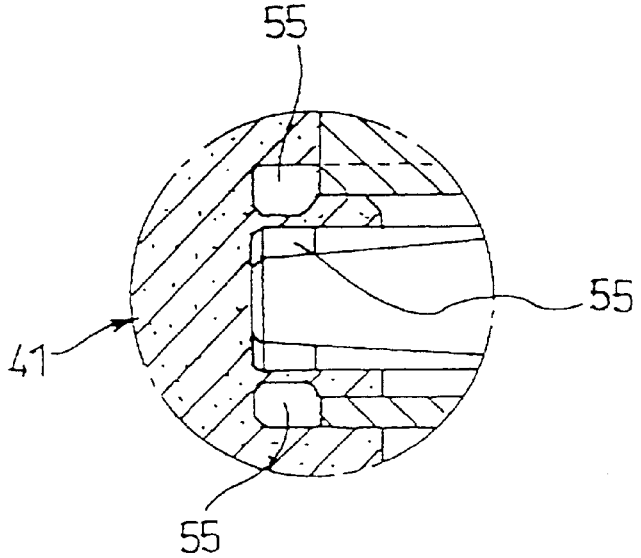
FIG. 3 is an enlarged diagram of a portion A in FIG. 2.

FIG. 1 is an exploded perspective view showing a waterproof connector according to a first embodiment of the present invention. FIG. 2 is an exploded cross-sectional view showing the state where gel is integrally retained in a rear holder in FIG. 1. FIG. 3 is an enlarged diagram of portion A in FIG. 2.

As is shown in FIGS. 1 and 2, multiple terminal chambers 33 are vertically and horizontally arranged in a housing 31, which is integrally formed of a synthetic resin. A hollow portion 35 is defined inside the housing 31, and multiple openings for terminal attachments are formed in an abutment face 37, the bottom of the hollow portion 35, and communicate with the respective terminal chambers 33. One part of the hollow portion 35 is a space wherein the gel and a part of the rear holder, which will be described later, are stored.

The hollow portion 35 serves as an opening 31*a* at the rear of the housing 31 (the right end in FIG. 2). A mat-shaped sealing member (gel) 41, for which silicon rubber, for example, can be employed, is inserted through the opening 31*a*. The external shape of the gel mat 41 is substantially the same as the cross-sectional shape of the hollow portion 35. When the gel mat 41 is inserted through the opening 31*a* into the hollow portion 35, one face (the front face on the insertion side) of the gel mat 41 is held in contact with the abutment face 37.

A rear holder 43 is attached to the rear (the right in FIG. 2) of the housing 31. An insertion portion 45, which is to be inserted into the opening 31*a* in the hollow portion 35, is formed at the front (the left in FIG. 2) of the rear holder 43. A distal end 45*a* of the insertion portion 45 is positioned parallel to the abutment face 37. Multiple insertion passages 47 for the terminals, open at both ends, are formed at the distal end 45*a* of the insertion portion 45 and at the rear (the right side in FIG. 2) of the rear holder 43. The insertion passages 47 are linearly arranged along the same line as the corresponding openings 39.

A flexible engagement frame 49 is formed with the outer walls of the rear holder 43. Provisional engagement protrusions 51 and plenary engagement protrusions 53, for engaging the engagement frame 49, are formed at intervals, in the direction in which the rear holder 43 enters, at the rear of the outer walls of the housing. When the insertion portion 45 is inserted into the opening 31*a* and the engagement frame 49 engages the provisional engagement protrusions 51 and the plenary engagement protrusions 53, one after another, the rear holder 43 is fitted over the rear end of the housing 31 in the provisional engagement state and then in the plenary engagement state.

When the rear holder 43 is temporarily engaged at the rear of the housing 31, the distal end 45*a* of the insertion portion 45 is located, apart from the abutment face 37, at the position where the gel mat 41 is in the uncompressed state. When the rear holder 43 is plenarily engaged at the rear of the housing 31, the distal end 45*a* of the insertion portion 45 is located, separate from the abutment face 37, at the position where pressure is placed on the gel mat 41 and it is set in the uncompressed state.

That is, the rear holder 43 can be positioned both at the provisional engagement position, whereat the gel mat 41 is not compressed, and at the plenary engagement position, whereat the gel mat 41 is compressed by pressure that impels it toward the abutment face 37.

As is shown in FIG. 3, four pawl-shaped protrusions 55, formed for the rear holder 43, project from the inner walls of the insertion passages 47 toward the distal end 45*a*, and vertically and horizontally surround the insertion passages 47. A pawl is formed at the distal end of each protrusion 55, and is embedded in the gel mat 41 to hold the gel mat 41 on the distal end 45*a*.

It should be noted that, as is shown in FIG. 2, the gel mat 41 may be integrally held by the protrusions 55 when it has been attached to the rear holder 43 in advance. Further, the gel mat 41 may be positioned in advance in the hollow portion 35 of the housing 31, and may be integrally held by the protrusions 55 when the rear holder 43 is set in the provisional engagement state. In either case, when the gel mat 41 is held by the protrusions 55, the circumference (near the portion through which the terminal passes) of the area around the insertion passages 47 is held and fixed.

The operation of a waterproof connector 61 having the above arrangement will now be described.

Figure 4A:
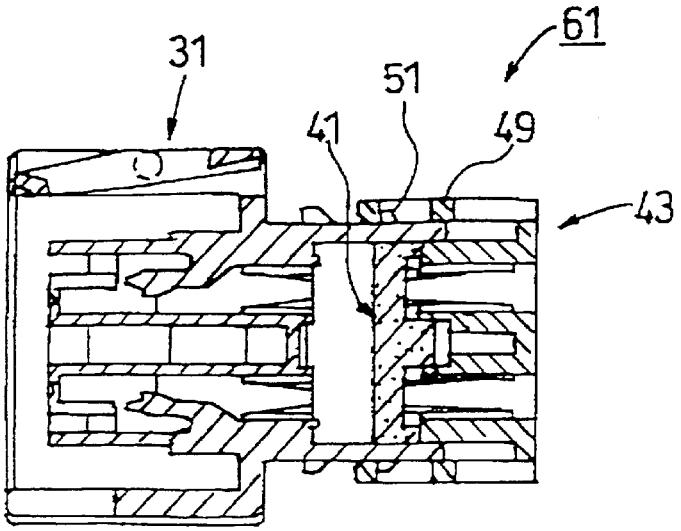
FIGS. 4A to 4C are cross-sectional views showing the process for assembling a waterproof connector of FIG. 2.
Figure 4B:
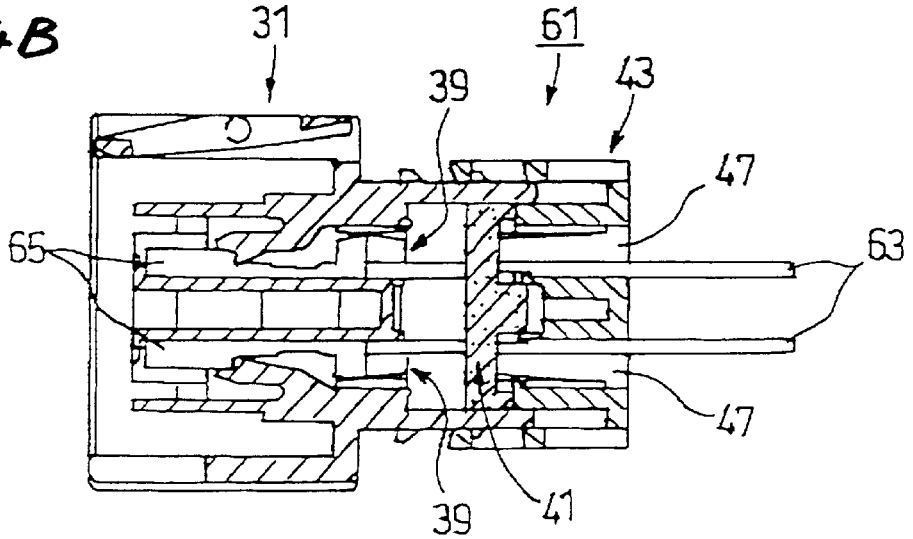

FIG. 4 is a cross-sectional view of the process by which the waterproof connector 61 in FIG. 2 is assembled.

In order for terminals 65, connected to electric wires 63, to be attached to the waterproof connector 61, as is shown in FIG. 4A, first, the rear holder 43, in which the gel mat 41 has been mounted is attached from the rear of the housing 31, and the engagement frame 49 is fitted over the protrusions 51. In this manner, the rear holder 43 is aligned at the provisional engagement position.

In this state, when the terminals 65 are inserted into the insertion passages 47 from the rear of the rear holder 43, the distal ends of the terminals 65 abut upon the gel mat 41 that is attached in front around and along the insertion passages 47. Then, when the terminals 65 are moved further forward, they tear through the surface of the gel mat 41, penetrating it in the direction of its thickness.

When in this manner the rear holder 43 has temporarily engaged the rear of the housing 31, no compressive force is exerted against the gel mat 41. Thus, while encountering little resistance, the terminals 65 can penetrate and pass through the gel mat 41 before pressure has been applied thereto.

Since the protrusions 55 (see FIG. 3) for holding the gel mat 41 hold and secure it near the portion being penetrated by the terminals 65, overall distortion of the gel mat 41, resulting from the passage through it of the terminals 65, can be prevented, and the local shearing force acts on the gel mat 41. Therefore, since the gel mat 41 can be protected from being pulled more than is necessary and from being excessively extended and thinned, a terminal penetration portion having superior sealing properties is provided.

The terminals 65 are passed through the gel mat 41 and advance to the openings 39, while their trailing electric wires 63 are drawn into and continue to pass through the gel mat 41, which closely contacts their outer circumferences. After the terminals 65 pass through the gel mat 41 and, via the openings 39, enter the terminal chambers 33, they engage with flexible arms in the terminal chambers 33 and are retained therein.

Figure 4C:
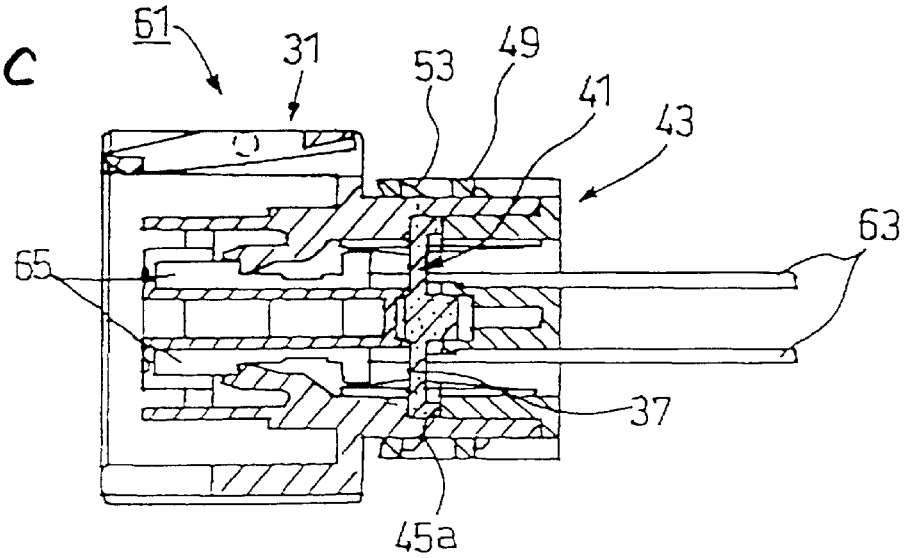

In this state, as is shown in FIG. 4C, when the rear holder 43 is advanced so it encompasses more of the housing 31, and the engagement frames 49 engage with the plenary engagement protrusions 53, the rear holder 43 is aligned at the plenary engagement position of the housing 31.

When the rear holder 43 is aligned at the plenary engagement position in the housing 31, the distal end 45*a* of the rear holder 43 pushes and compresses the gel mat 41 against the abutment face 37, while the compressed gel mat 41 closely contacts the outer walls of the electric wires 63 and the inner walls of the housing 31 and the rear holder 43. Therefore, even when a gap is formed among these members, it is closed by the compressed gel mat 41. Thus, the electric wires 63, the housing 41 and the rear holder 43 are securely sealed by the gel mat 41 and a waterproof state is provided.

As is described above, according to the waterproof connector of the first embodiment, since the rear holder 43 can be positioned both at the provisional engagement position, whereat the gel mat 41 is not compressed, and at the plenary engagement position, whereat the gel mat 41 is propelled toward and compressed against the abutment face 37, the terminals 65 can be passed through the gel mat 41 before it is compressed. Thus, resistance to the penetration of the terminals 65 can be reduced, and the operational efficiency can be improved.

Since the protrusions 55 for holding the gel mat 41 are provided for the rear holder 43, the gel mat 41 can be secured near the terminal penetration portion, overall distortion of the gel, occasioned by the passage through it of the terminals 65, can be prevented, and the local shearing force can act on the gel mat 41.

Therefore, when the terminals 65 pass through the gel mat 41, the gel mat 41 can be protected from being pulled more than necessary and from being excessively extended and thinned, so that a terminal penetration portion having superior sealing properties can be provided.

In addition, since the gel mat 41 is mounted in the rear holder 43 in advance, it can be attached together with the rear holder 43, and the efficiency of the assembly process can be improved.

Figure 5:
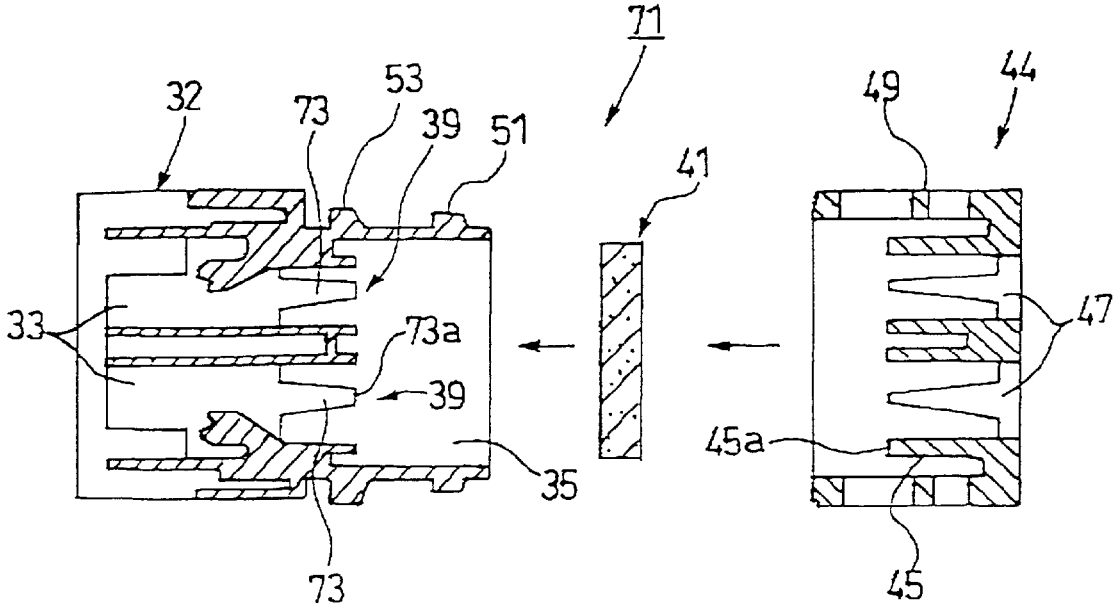
FIG. 5 is an exploded perspective view showing a waterproof connector according to a second embodiment of the invention.
Figure 6:
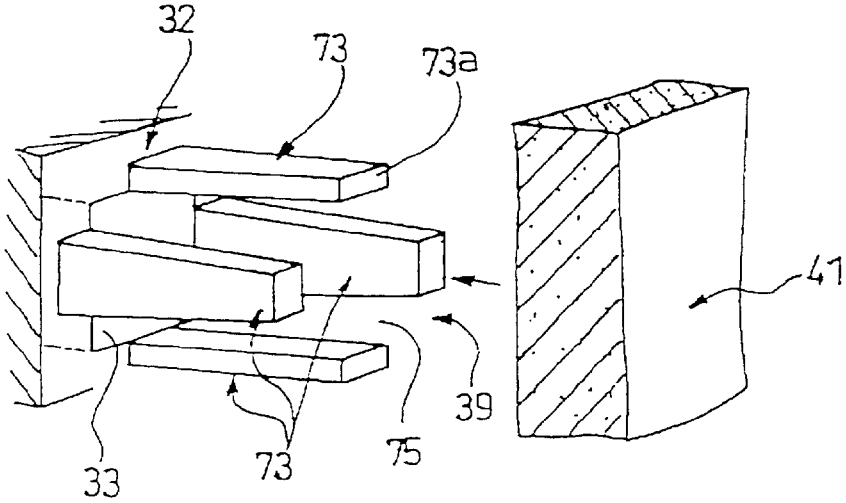
FIG. 6 is an enlarged perspective view of an opening for a terminal attachment in FIG. 5.

FIG. 5 is an exploded cross-sectional view of a waterproof connector according to a second embodiment of the invention. FIG. 6 is an enlarged perspective view of openings in the terminal attachment in FIG. 5. The same reference numerals as are used in FIGS. 1 to 4 for the first embodiment are used in FIGS. 5 and 6 to denote corresponding and identical components, and no further explanation for them will be given.

For a waterproof connector 71 according to the second embodiment, openings 39 for terminal attachment are, for example, quadrilaterally shaped. As is shown in FIG. 6, in a housing 32, projections 73 project outward from the inner walls of terminal chambers toward the rear. In this example, the four projections 73 are vertically and horizontally positioned, so that they surround the terminal chambers 33. Distal ends 73*a* of the projections 73 are on the same plane as the abutment face 37 of the housing 31 for the first embodiment, and form the inner wall for this embodiment.

The projections 73 are shorter than the individual sides of the quadrilaterally shaped openings 39, and define gaps at the corners of the openings 39. These gaps serve as runoff gaps 75.

Furthermore, a rear holder 44 is attached to the rear (right in FIG. 5) of the housing 32, in the same manner as is the waterproof connector 61.

The operation of the thus arranged waterproof connector 71 will now be explained.

Figure 8:
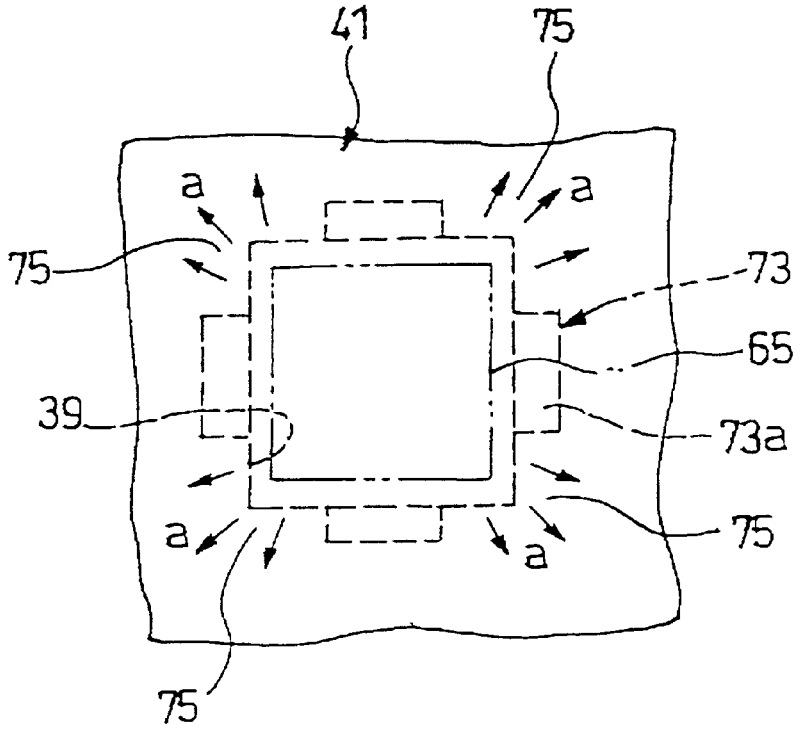
FIG. 8 is an explanatory diagram showing the direction in which a gel escapes the insertion of the terminals.
Figure 9:
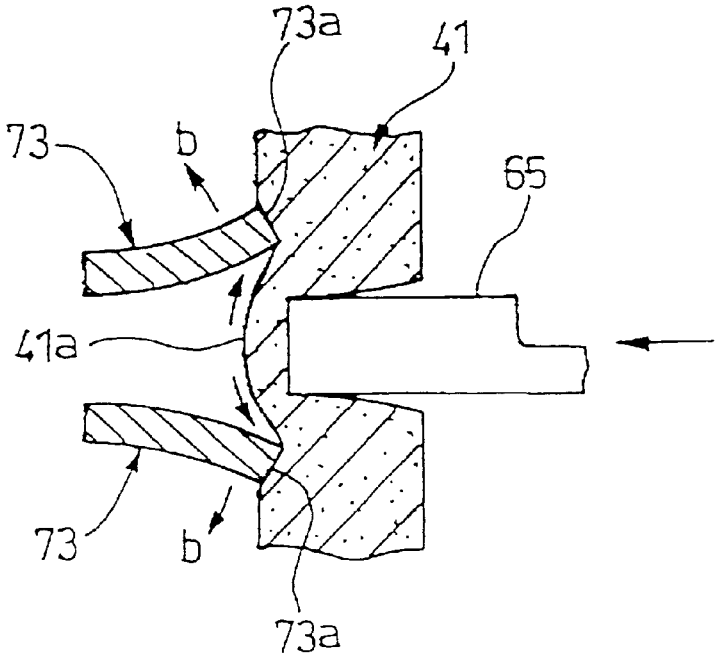
FIG. 9 is an explanatory diagram showing the states of projections and the gel upon the insertion of the terminals.

FIG. 7 is a cross-sectional view of the assembly process for the waterproof connector 71 in FIG. 5. FIG. 8 is an explanatory diagram showing the direction in which the gel mat 41 escapes when the terminals 65 are inserted. And FIG. 9 is an explanatory diagram showing the states of the projections 73 and the gel mat 41 when the terminals 65 are inserted.

Figure 7A:
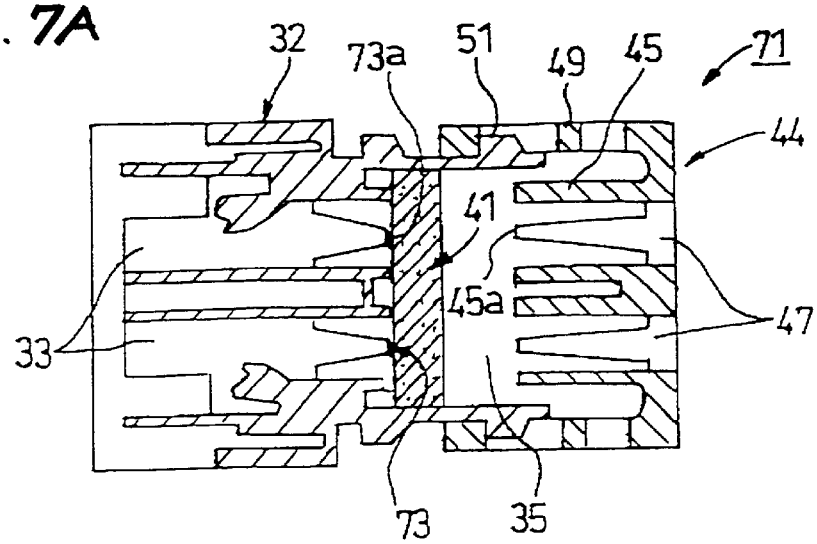
FIGS. 7A to 7C are cross-sectional views showing the process for assembling a waterproof connector of FIG. 5.

In order to attach to the waterproof connector 71 the terminals 65 connected to the electric wires 63, first, as is shown in FIG. 7A, the gel mat 41 is inserted into a hollow portion 35, and is brought into contact with the distal ends 73*a* that together constitute the inner wall of the housing 32.

Then, the rear holder 44 is fitted over the rear of the housing 32, and engagement frames 49 engage provisional engagement protrusions 51, and the rear holder 44 is aligned at the provisional engagement position of the housing 32.

Figure 7B:
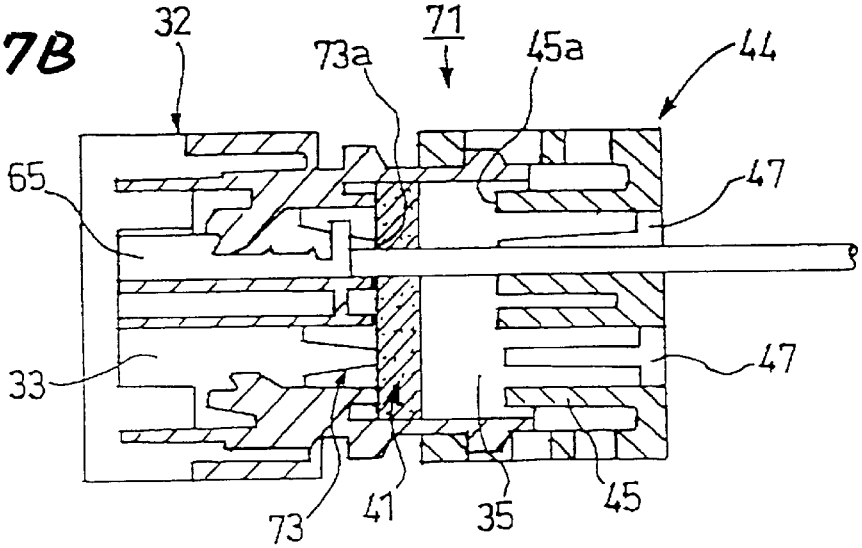

In this state, as is shown in FIG. 7B, when the terminals 65 are inserted from the rear of the rear holder 44 into insertion passages 47, the distal ends of the terminals 65 abut upon the gel mat 41 in the hollow portion 35. When the terminals 65 are impelled farther forward, they tear through the surface of the gel mat 41 and pass through the gel mat 41 in the direction of its thickness.

When in this manner the rear holder 44 is temporarily engaged at the rear of the housing 32, no compressive force is exerted against the gel mat 41. Thus, since the terminals 65 are passed through the gel mat 41 before pressure is applied, they encounter little resistance.

Then, as is shown in FIG. 6, the face of the gel mat 41 opposite the face against which the terminals 65 are pressed is supported by the distal ends 73*a* of the projections 73. When pressure is exerted on the gel mat 41 by the terminals 65, part of the gel mat 41 is extended to the face supported by the projections 73. This extended portion escapes into the runoff gaps 75 defined between the projections 73 in the directions indicated by arrows a in FIG. 8.

Figure 12:
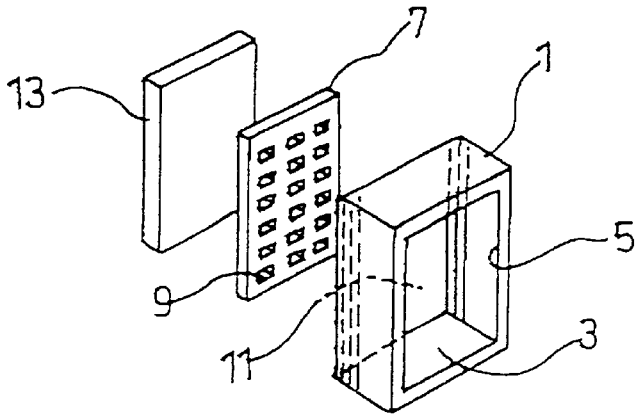
FIG. 12 is an exploded perspective view of a rear holder in a related waterproof connector.
Figure 13:
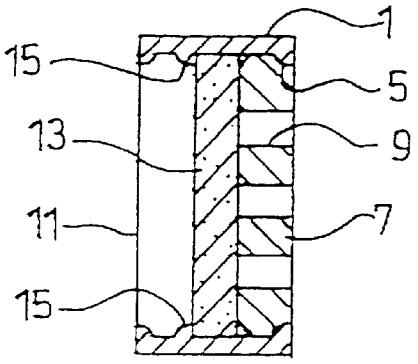
FIG. 13 is a cross-sectional view of the rear holder of the related waterproof connector in which a gel is retained.
Figure 14:
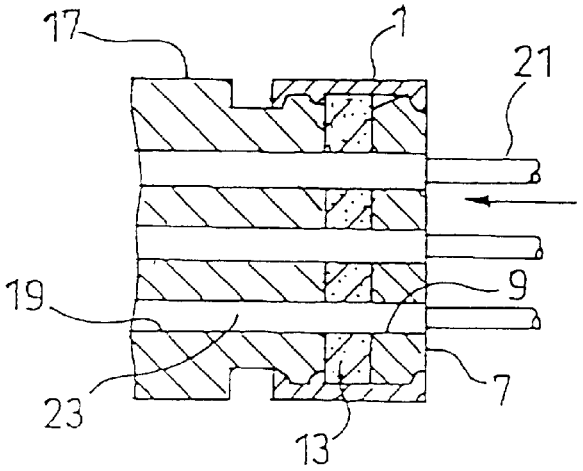
FIG. 14 is a cross-sectional view of an essential portion of the related connector.
Figure 15:
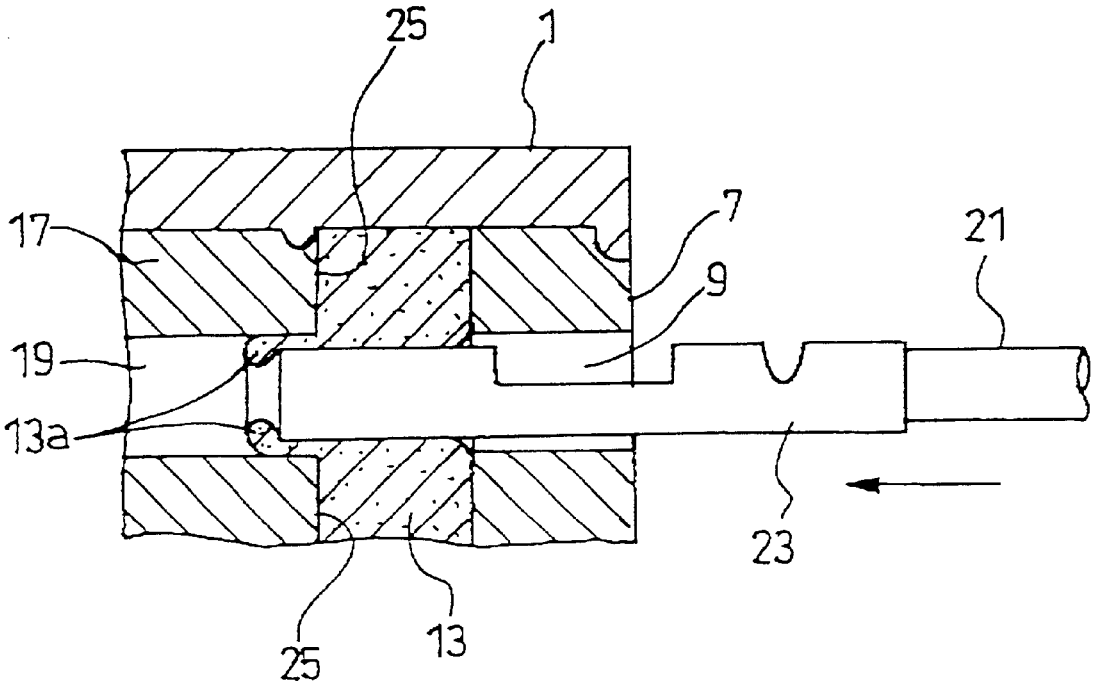
FIG. 15 is a cross-sectional view of the extended portions of the gel that are cut off by inserting terminals.
Figure 16:
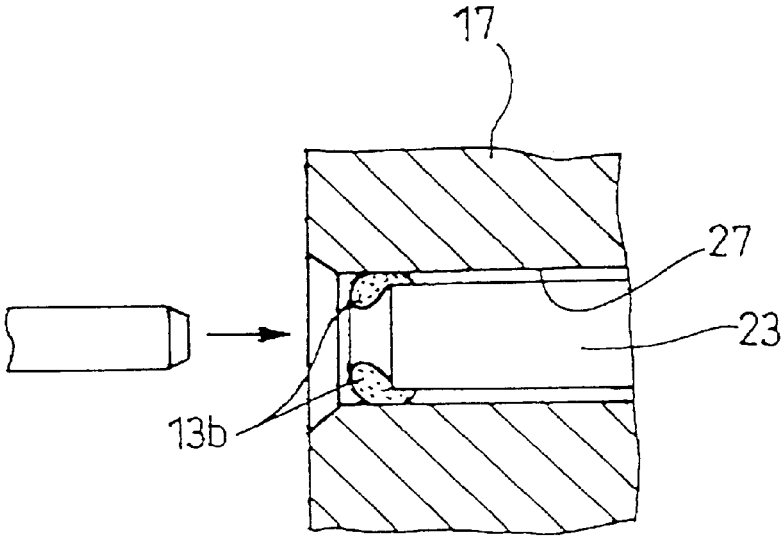
FIG. 16 is an enlarged cross-sectional view of the coupled portion of the related waterproof connector with which gel chips are attached.

Therefore, while in the related waterproof connector in FIG. 12, the extended portions 13*a* are led to and pushed into the openings for terminal attachment, such a phenomenon does not occur with the waterproof connector in this embodiment. As a result, only the terminals 65 that penetrate the gel mat 41 enter the openings 39. Following this, the electric wires 63 are passed through, and their outer faces are closely contacted by the gel mat 41.

The degree of pressure imposed on the gel mat 41 when the terminals 65 are inserted is also limited by another action. That is, as is shown in FIG. 9, when a terminal 65 is driven against the gel mat 41, the distal ends of the projections 73, against which pressure is exerted, are deformed in directions b, so that they are they are further separated from each other. As a result, as the displacement of the projections 73 continues, the surface of the gel mat 41, which is supported by the distal ends 73*a* of the projections 73, is pulled in the directions b in which the projections 73 are deformed.

An extended portion 41*a,* nearer the terminal chamber 33, when pressed forward by a terminal 65 is thinner than a case where the projections 73 are not deformed. Therefore, as the terminal 65 is pressed against the extended portion 41*a,* the portion of the gel mat 41 in the side from which the terminal 65 is projected is contracted in the directions b, so that it is separated, circumferentially, from the terminal 65. As a result, the extended portion 41*a* is prevented from entering the opening 39.

The terminal 65, which is passed through the gel mat 41, enters the terminal chamber 33, via the opening 39, and engages with a flexible arm in the terminal chamber 33 and is retained therein.

Figure 7C:
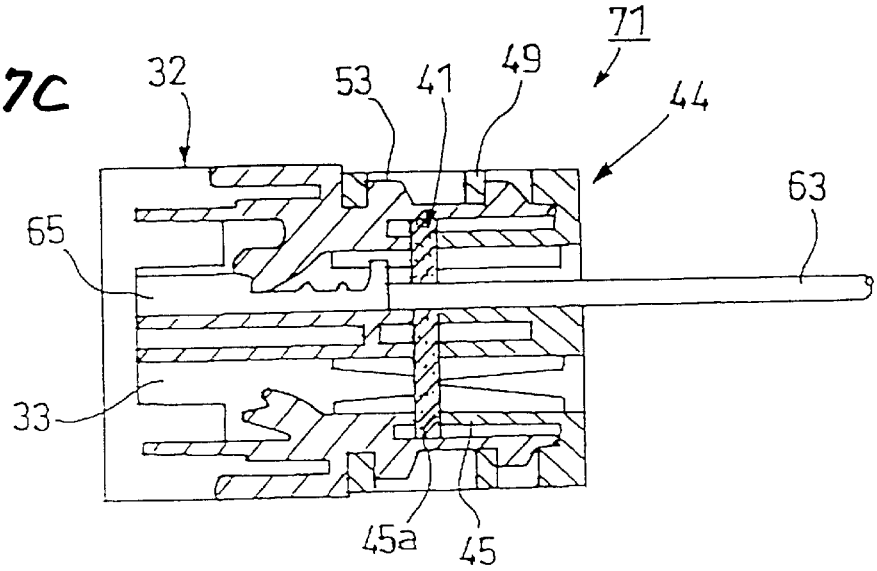

When in this state, as is shown in FIG. 7C, the rear holder 44 is moved forward and approaches the housing 32, and the engagement frames 49 engage with the plenary engagement protrusions 53, the rear holder 44 is aligned at the plenary engagement position of the housing 32.

When, as for the waterproof connector 61, the rear holder 44 has been set at the plenary engagement position of the housing 32, the distal ends 45*a* of the insertion portions 45 compress the gel mat 41, so that the compressed gel mat 41 closely contacts the circumferential outer walls of the electric wires 63 and the inner walls of the housing 32 and the rear holder 44. Therefore, even when a gap is formed among these members, it is closed by the compressed gel mat 41, and secure seals are provided by the gel mat 41 for the electric wires 63, the housing 32 and the rear holder 44.

Because of the two actions in FIGS. 8 and 9, in the waterproof connector 71, the entry of the gel mat 41 into the opening 39 is unerringly prevented. It should be noted that either one of these two actions can prevent the entry of the extended portion 41*a* into the opening 39.

As is described above, according to the waterproof connector 71 of the second embodiment, as well as the waterproof connector 61 of the first embodiment, the operational efficiency can be improved by reducing the resistance to the insertion of the terminals 65. Further, when the terminals 65 are passed through the gel mat 41, the extended portion 41*a* of the gel mat 41 can escape via the runoff gaps 75, and thus, the conveyance of the gel mat 41 into the openings 39 can be prevented.

When the terminals 65 are passed through the gel mat 41, the projections 73 are displaced in opposite directions, so that the extended portion 41*a* of the gel mat 41 is thinned. As a result, the conveyance of the gel mat 41 into the openings 39 can be prevented.

Therefore, the entry of gel mat 41 into the terminal chambers 33 is prevented, so that when connectors are coupled together, since in the terminal chambers 33 chips are not generated from gel mat 41 and the entry of such chips into electrical contact portions does not occur, conductive failures due to chips produced in this manner can be prevented.

FIGS. 10A and 10B and FIGS. 11A and 11B are cross-sectional views of the assembly process for a waterproof connector according to a third embodiment of the invention. Since the same reference numerals as are used in the previous two embodiments are also used in this embodiment to denote corresponding or identical components, no explanation for them will be given.

Figure 10A:
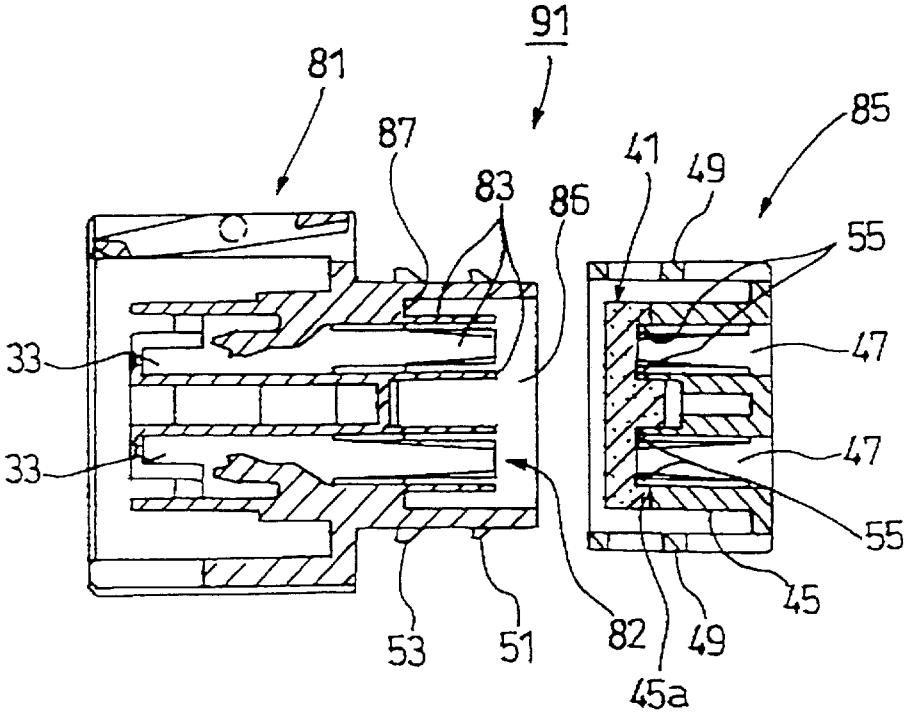
FIGS. 10A and 10B are cross-sectional views showing the process for assembling a waterproof connector according to a third embodiment of the invention.

For a waterproof connector 91 for the third embodiment, as is shown in FIG. 10A, a hollow portion 86 is defined inside a housing 81, and multiple quadrilaterally-shaped openings 82, for terminal attachments, that are formed in an abutment face 87 that is the bottom of the hollow portion 86, respectively communicate with terminal chambers 33.

Further, as is shown in FIG. 10A, guide projections 83 project from the inner walls of the terminal chambers 33 toward the rear of the housing 81. In this embodiment, four guide projections 83 surround a terminal chamber 33, and corner gaps defined by the guide projections 83 serve as runoff gaps.

Further, a rear holder 85, as well as the waterproof connector 61, is fitted over the rear (the right in FIG. 10) of the housing 81.

The projected guide projections 83 are nearer the rear than is the inner wall 87 at the position whereat the rear holder 85 is temporarily fitted over the housing 81, so that the guide projections 83 define terminal guide spaces communicating with insertion passages 47 for the rear holder 85, and guide the terminals 65 to the terminal chambers 33.

Specifically, when the rear holder 85 is temporarily fitted over the housing 81, the guide projections 83 face engagement protrusions 55 that project outward from the inner walls of the insertion passages 47 toward the distal end 45*a*, and define the terminal guide spaces that communicate with the insertion passages 47. Further, at their distal ends, the guide projections 83 and the engagement protrusions 55 are tapered, so that when the rear holder 85 is securely fitted over the housing 81, these protrusions overlap each other.

The operation of the thus arranged waterproof connector 91 will now be explained.

Figure 10B:
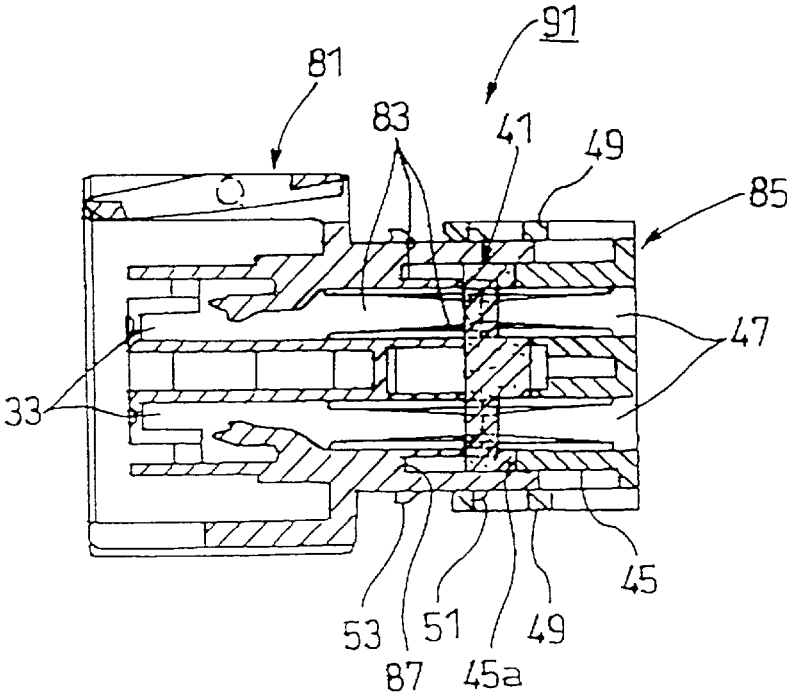

In order to attach, to the waterproof connector 91, the terminals 65 connected to electric wires 63, first, as is shown in FIG. 10A, the rear holder 85, wherein the gel mat 41 is mounted, is inserted from the rear of the housing 81, and the engagement frames 49 are fitted over the protrusions 55. Then, as is shown in FIG. 10B, the rear holder 85 is temporarily fitted over the housing 81.

Figure 11A:
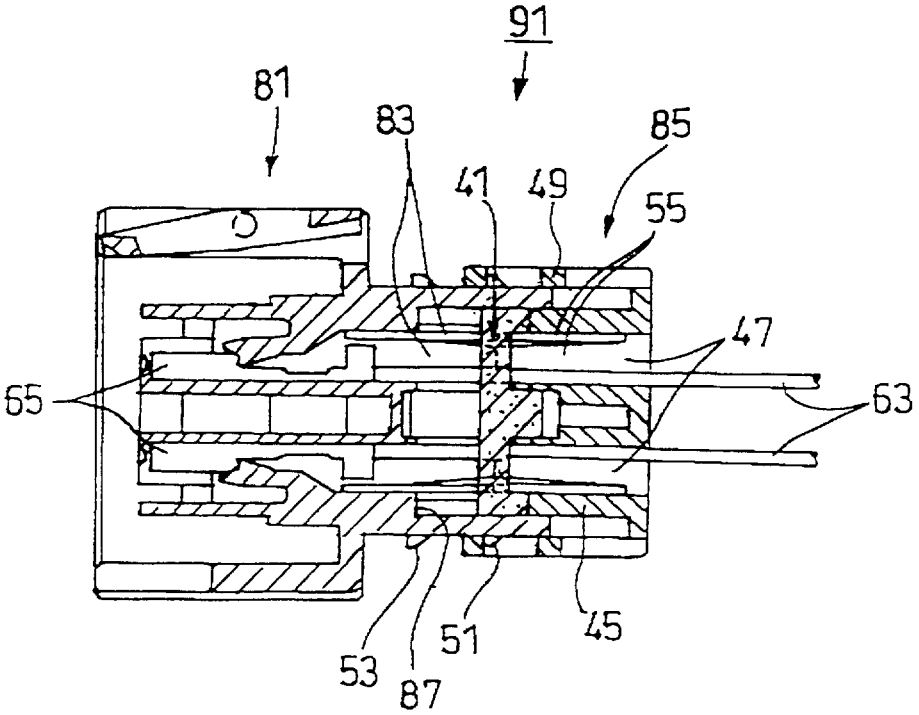
FIGS. 11A and 11B are cross-sectional views of the process for assembling the waterproof connector of FIG. 10.

In this state, when, as is shown in FIG. 11A, the terminals 65 are inserted, from the rear of the rear holder 85, into the insertion passages 47, the distal ends of the terminals 65 abut upon the gel mat 41 that is mounted in front of the insertion passages 47. Then, when the terminals 65 are further inserted, they tear through the surface of the gel mat 41 and penetrate it in the direction of its thickness.

When in this manner the rear holder 85 is temporarily aligned at the rear of the housing 81, compressive force is not exerted on the gel mat 41, and thus, since the terminals 65 are passed through the gel mat 41 before pressure is applied to it, they encounter little resistance.

Further, since the protrusions 55 for holding the gel mat 41 securely hold the gel mat 41 near the portion through which the terminals 65 are passed, the distortion of the gel mat 41 resulting from the penetration of the terminals 65 can be prevented, and the local shearing force can act on the gel mat 41. Thus, since the gel mat 41 can be protected from being pulled and extended more than is necessary, and from being excessively bent and thinned, a terminal penetrating portion having superior sealing properties can be provided.

Along the guide projections 83 that define the terminal guide spaces that communicate with the insertion passages 47, the terminals 65 passed through the gel mat 41 are accurately guided through corresponding openings 82 in the housing 81 to the terminal chambers 33. Therefore, the terminals 65 can be prevented from striking the inner walls 87 and from being inserted into incorrect terminal chambers 33.

Furthermore, when the gel mat 41 is impelled by the terminals 65 and part of it is extended toward the guide projections 83, this extended portion can escape to the corners defined as runoff gaps by the guide projections 83.

Therefore, while in the related waterproof connector 1 in FIG. 12 the extended portions 13*a* that can not escape are entered into the openings for terminal attachment, such a phenomenon is not encounter with the waterproof connector 91 in this embodiment. As a result, only the terminals 65 that penetrate the gel mat 41 enter the openings 82. While subsequently, the electric wires 63 are passed through the gel mat 41 and their outer faces are closely contacted by the gel mat 41.

The terminals 65, after passing through the gel mat 41, enter the terminal chambers 33, and the outer walls of the electric wires 63, which sequentially are passed through the gel mat 41, are closely contacted by the gel mat 41. Thereafter, the terminals 65, which have been passed through the gel mat 41 and have entered the terminal chambers 33, are engaged by the flexible arms in the terminal chambers 33, and are retained therein.

Figure 11B:
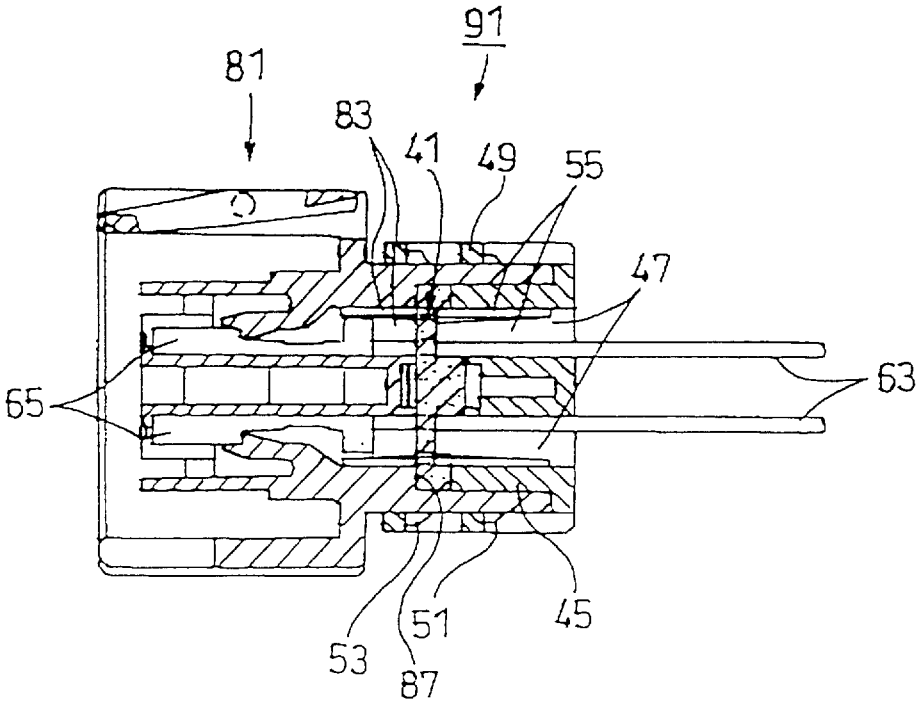

In this state, when as is shown in FIG. 11B the rear holder 85 is moved farther forward toward the housing 81, and the engagement frames 49 are fitted over the plenary engagement protrusions 53, the rear holder 85 is aligned at the plenary engagement position of the housing 81.

At this time, since the guide projections 83 and the protrusions 55 are guided along the distal tapered portions and overlap each other, the movement, of the rear holder 85 toward the housing 81 is not adversely affected.

Then, when the rear holder 85 is secured to the housing 81 at the plenary engagement position, the distal end 45*a* of the rear holder 85 pushes and compresses the gel mat 41 against the inner walls 87, so that the compressed gel mat 41 closely contacts the outer walls of the electric wires 63 and the inner walls of the housing 81 and the rear holder 85.

Therefore, even when a gap is present among these members, it is closed by the compressed gel mat 41, and as a result, secure seals can be provided for the electric wires 63, the housing 81 and the rear holder 85 by the gel mat 41.

As is described above, according to the waterproof connector 91 for the third embodiment, as well as the waterproof connectors 61 and 71 in the first and the second embodiments, operational efficiency can be increased by reducing the resistance encountered by the terminals 65. In addition, when the terminals 65 are inserted into the terminal chambers 33, the guide projections 83 can be employed to prevent the terminals 65 from striking the inner walls 87 or from being inserted into the wrong terminal chambers 33.

As a result, when the terminals 65 are inserted into the terminal chambers 33 while the rear holder 85 is temporarily fitted, there is no possibility that the terminals 65 will hit the inner walls 87 and bend the terminals 65 or the housing 81, or that the terminals 65 will be erroneously inserted into incorrect terminal chambers 44 and will have to be re-inserted later. Therefore, improved operational efficiency is ensured.

In the third embodiment, the four guide projections 83 are vertically and horizontally provided and surround the terminal chambers 33 while forming the runoff gaps. However, no opportunity is presented for the distal ends of the guide projections 83 to contact the distal ends of the terminals 65 and to be bent by them. And since the guide projections 83 are not bent, it is possible to prevent the escape of the gel mat 41 and to prevent it from entering the terminal chambers 33. Therefore, all conductive failures due to gel chips can be prevented.

For the waterproof connector of the invention, the housing, the gel, the rear holder, the engagement protrusions, the runoff gaps and the guide projections are not limited to those in the embodiments, and various modifications can be effected without departing from the scope of the invention.

What is claimed is:

1. A waterproof connector, comprising:

a housing, provided with an abutment face formed inside there of so as to define an insertion opening to which an electric wire terminal is inserted, and a chamber for accommodating the inserted terminal;

a gel member, through which the terminal penetrates before being inserted to the chamber;

a holder, provided with an insertion passage through which the terminal passes before penetrating the gel member, the holder engaged with the housing while being movable between a provisional engagement position and a plenary engagement position, wherein the gel member is compressed against the abutment face of the housing when the holder is placed in the plenary engagement position;

wherein the gel member is held by the holder without compressing against the abutment face, when the holder is placed in the provisional engagement position, and wherein the holder includes an engagement member for holding the gel member while preventing the gel member from moving toward the penetrating direction of the terminal.

2. The waterproof connector as set forth in claim 1, wherein projections are formed in the housing so as to surround the insertion opening, while defining a space for which a part of the compressed gel member runs off.

3. The waterproof connector as set forth in claim 1, wherein a guide projection is formed in the housing so as to surround the insertion opening; and wherein the guide projection is inserted into the insertion passage of the holder, for guiding the insertion of the terminal, when the holder is placed in the provisional engagement position.

4. A waterproof connector, comprising:

a housing, provided with an abutment face formed inside there of so as to define an insertion opening to which an electric wire terminal is inserted, and a chamber for accommodating the inserted terminal;

a gel member, through which the terminal penetrates before being inserted to the chamber; and a holder, provided with an insertion passage through which the terminal passes before penetrating the gel member, the holder engaged with the housing while being movable between a provisional engagement position and a plenary engagement position, wherein the gel member is compressed against the abutment face of the housing when the holder is placed in the plenary engagement position, wherein the gel member is held by the holder without compressing against the abutment face, when the holder is placed in the provisional engagement position and wherein projections are formed in the housing so as to surround the insertion opening, while defining a space for which a part of the compressed gel member runs off.

5. A waterproof connector, comprising:

a housing, provided with an abutment face formed inside there of so as to define an insertion opening to which an electric wire terminal is inserted, and a chamber for accommodating the inserted terminal;

a gel member, through which the terminal penetrates before being inserted to the chamber; and a holder, provided with an insertion passage through which the terminal passes before penetrating the gel member, the holder engaged with the housing while being movable between a provisional engagement position and a plenary engagement position, wherein the gel member is compressed against the abutment face of the housing when the holder is placed in the plenary engagement position, wherein the gel member is held by the holder without compressing against the abutment face, when the holder is placed in the provisional engagement position, wherein a guide projection is formed in the housing so as to surround the insertion opening; and wherein the guide projection is inserted into the insertion passage of the holder, for guiding the insertion of the terminal, when the holder is placed in the provisional engagement position.

* * * * *